US005084925A

United States Patent [19]

Cook

[11] Patent Number: 5,084,925

[45] Date of Patent: Feb. 4, 1992

[54] HOSPITAL BED GUARD EXTENDER

[75] Inventor: Stuart A. Cook, Duluth, Ga.

[73] Assignee: Product Strategies, Inc., Duluth, Ga.

[21] Appl. No.: 656,984

[22] Filed: Feb. 19, 1991

[51] Int. Cl.[5] ..... A47C 21/08

[52] U.S. Cl. ..... 5/425; 5/428; 5/503.1

[58] Field of Search ..... 5/424, 425, 427–429, 5/508, 512

[56] References Cited

U.S. PATENT DOCUMENTS 3,048,857 8/1962 Hutt ..... 5/429
3,220,024 11/1965 Nelson ..... 5/429
3,262,133 7/1966 Beitzel ..... 5/429 X
3,932,903 1/1976 Adams et al. ..... 5/100
4,439,880 4/1984 Koncelik et al. ..... 5/429

*Primary Examiner*—Michael F. Trettel
*Attorney, Agent, or Firm*—Bailey & Hardaway

[57] ABSTRACT

A standard hospital bed having a collapsible guard rail which provides for gap space which improvement is a telescoping extender mounted on the guard rail and movable between two positions one of which is in the gap defining position and the other position which closes the gap to prevent unintentional movement through such gap by a patient.

3 Claims, 3 Drawing Sheets

HOSPITAL BED GUARD EXTENDER

BACKGROUND OF THE INVENTION

This invention relates generally to the art of hospital beds and more particularly to a safety apparatus to prevent patient injury.

Hospital beds have conventionally been utilized having collapsible guard rails on either side of the bed to prevent a patient from unintentionally rolling from the bed. The guard rails are collapsible so as to permit normal patient ingress and egress as well as medical treatment of the patient. One such apparatus is disclosed in U.S. Pat. No. 4,125,446 while other U.S. patents disclose hospital bed guard systems 4,232,415, 2,648,075, 2,751,608, 1,062,127, 4,771,292 and 3,376,066.

While these collapsible guard rails have functioned satisfactorily for many patients, other patients have managed to injure themselves while such guard rails are in place.

SUMMARY OF THE INVENTION

It is thus an object of this invention to provide an improved hospital bed guard rail which closes gaps that may result in patient injury.

It is a further object of this invention to provide such an improvement which may be added to conventional bed guards to improve their performance.

It is yet a further object of this invention to provide a novel telescoping apparatus which may be utilized to close gaps formed in a bed structure which may allow patients to inadvertently slip through such gaps.

These as well as other objects are accomplished by an improvement for a standard hospital bed having a collapsible guard rail which provides for gap space which improvement is a telescoping extender mounted on the guard rail and movable between two positions one of which is in the gap defining position and the other position closes the gap to prevent unintentional movement through such gap by a patient.

DETAILED DESCRIPTION

In accordance with this invention it has been found that significant patient safety may be brought about by providing guards extenders on conventional hospital which may be moved between two positions so as to close gaps which exist about the perimeter of a standard hospital bed.

Various other features and advantages will become apparent from a reading of the following description given with reference to the various figures and drawings.

Figure 1:
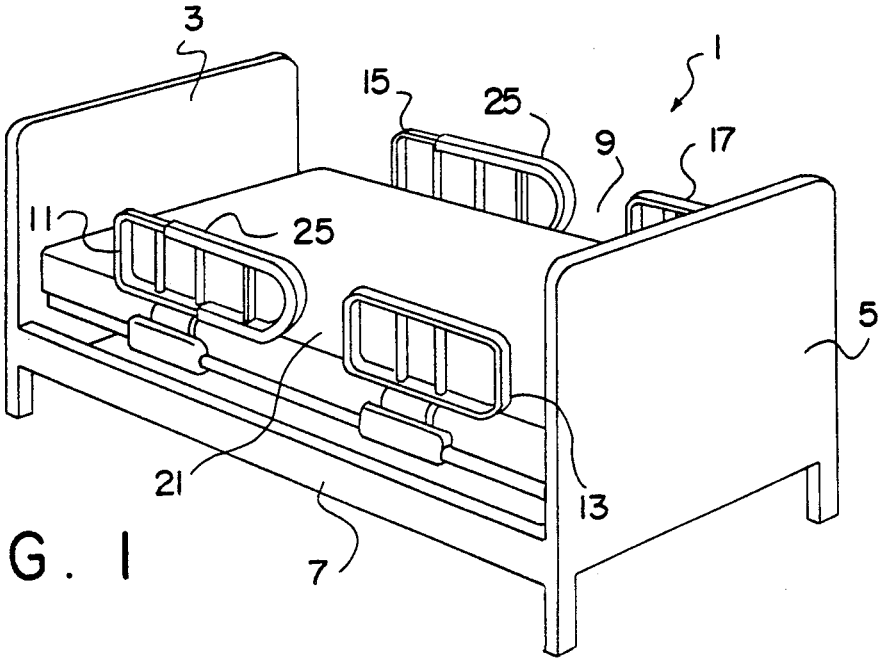
FIG. 1 of the drawings is a perspective view of a standard hospital bed having the improvement of this invention mounted thereon.

FIG. 1 of the drawings illustrates a conventional hospital bed 1 having a headboard 3 a footboard 5 and longitudinal sides 7 and 9. Illustrated about the perimeter of the hospital bed are collapsible guard rails 11, 13, 15 and 17. It should be noted that between collapsible guard rails 11 and 13 there exists a gap 21.

Upon collapsible guard rail 11 as well as collapsible guard rail 15 there is illustrated a telescoping guard rail extender 25 which is moveable between two positions with one position maintaining the gap 21 and the other position closing the gap 21.

Figure 2:
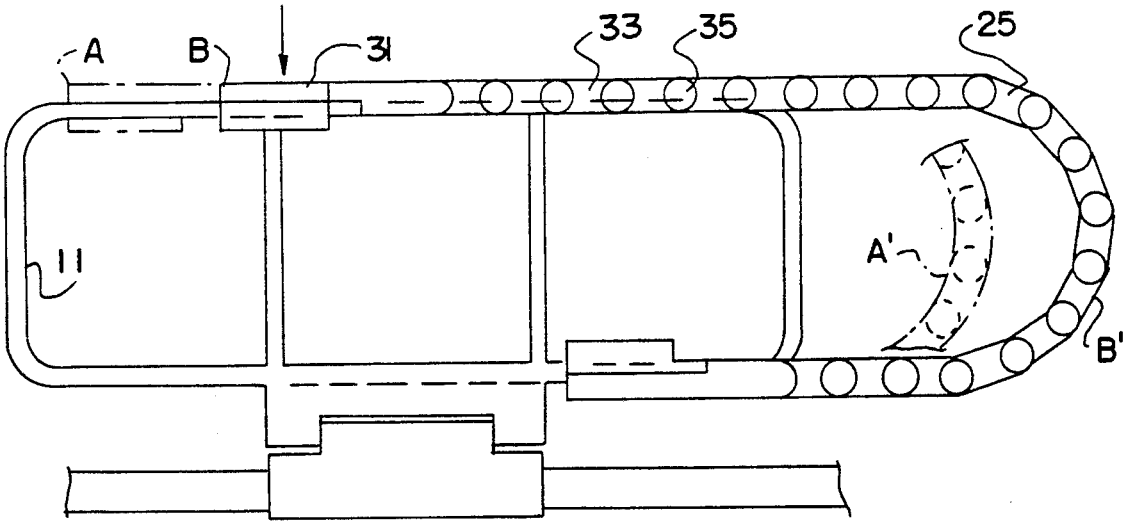
FIG. 2 of the drawings illustrates a front view of a guard rail showing the extender of this invention in two positions.

This may be better understood by referring to FIG. 2 which is a front view of the guard rail having the extender 25 thereon. It is seen that the telescoping extender 25 is moveable between two positions marked at the left side A and B and on the right side A′ and B′. This is brought about by moving slidably locking member 31 between the A position and B position thus causing the extender to move between the A′ position and B′position which closes gap 21 of FIG. 1.

It is seen that the extender is formed of a plurality of members 33 which rotatably interlock through joint 35. It is seen that the slidable locking member 31 locks upon the rail 11 to be slidably tracked thereon between the A position and B position.

Figure 3:
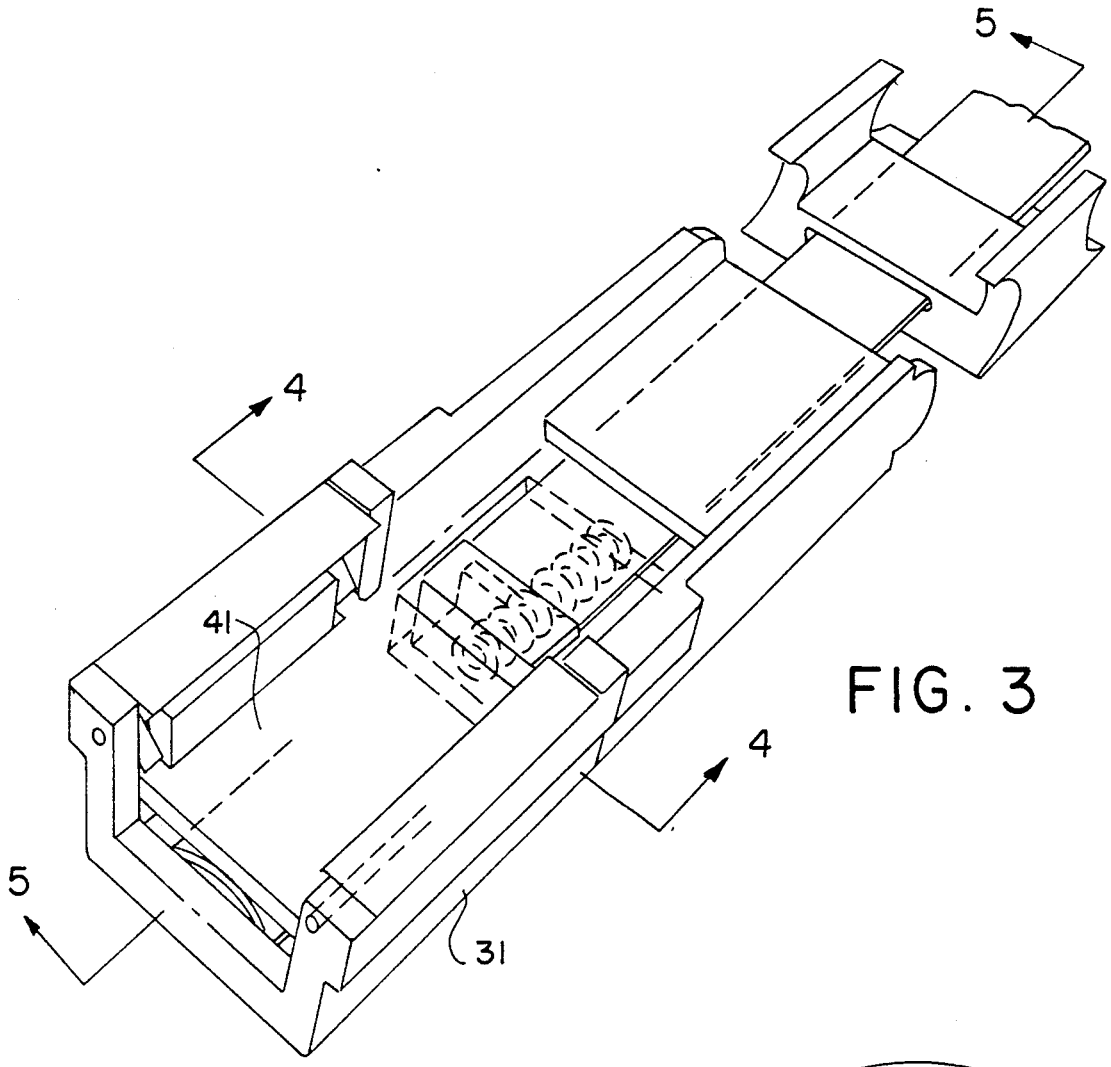
FIG. 3 of the drawings is a perspective view from the bottom of an extender in accordance with this invention.
Figure 4:
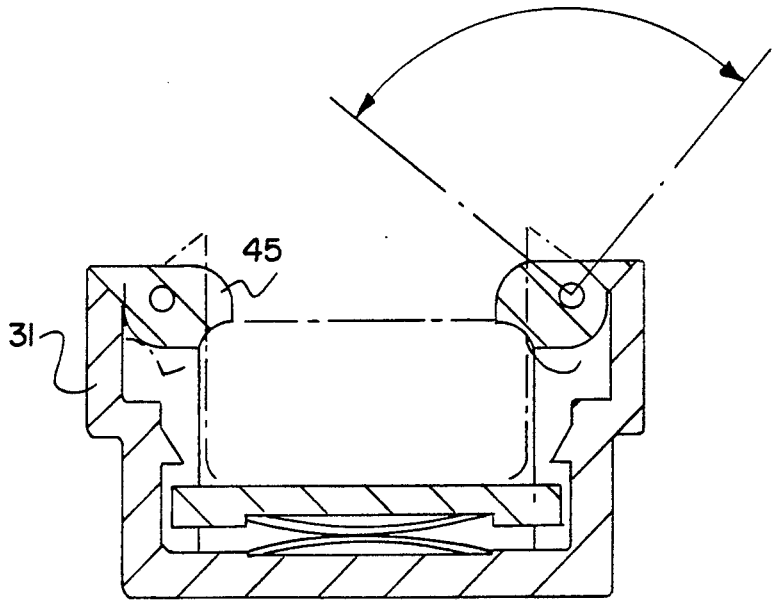
FIG. 4 of the drawings is a cross-sectional view along the line 4—4 of FIG. 4.

FIG. 3 of the drawings is a view from the bottom of slidable locking member 31 showing the space 41 which locks upon rail 11. This is yet better seen from FIG. 4 wherein rotatable locks 45 permit placement about a rail 11.

Figure 5:
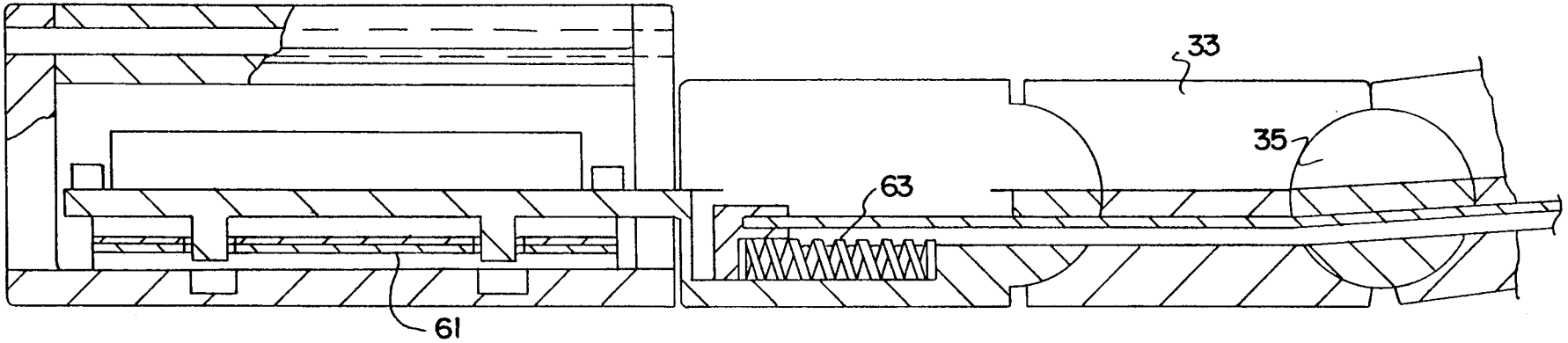
FIG. 5 of the drawings is a cross-sectional view along the line 5—5 of FIG. 3.

FIG. 5 of the drawings is a cross-sectional view along the line 5—5 of FIG. 3 which illustrates a tensioning means 6 running between individual elements 33 and through the rotatable juncture 35 thereof to maintain tension on the entire apparatus. Compression spring 63 maintains appropriate tension on the entire apparatus as it is telescoped between two positions to close gaps about a hospital bed.

It is thus seen that not only may the telescoping be utilized to close gaps between adjacent guard rails but may be appropriately mounted on opposite sides of guard rail so as to close gaps between the guard rail and headboard and footboard of a hospital bed as well.

It is thus seen that the improvement of this invention provides an improvement to a standard hospital bed so as to make such safer and to make it considerably less likely to have a patient injured because of movement through gaps about the perimeter of a hospital bed. As many variations will become apparent to those of skill in the art from a reading of the foregoing disclosure which is exemplary in nature, such variations are embodied within the spirit and scope of this invention as defined by the following appended claims.

That which is claimed is:

1. In a hospital bed having a backboard, a footboard, longitudinal sides between said headboard and footboard and at least one collapsible guard rail on one side of said bed, at least one gap defined adjacent said guard rail, the improvement comprising:

a telescoping extender mounted upon said guard rail by a slidable member that mounts about said guard rail moveable between two positions, a first of said positions defining said gap and a second of said positions closing said gap.

2. The improvement according to claim 1 further comprising:

two collapsible guard rails on either side of said bed structure with said telescoping guard rail extender on at least one of said guard rails on each side of said bed whereby a gap defined between two bed guards on each side is closed by moving said guard rail extender to said second position.

3. In a hospital bed having a headboard, footboard, longitudinal sides between said headboard and footboard and at least one collapsible guard rail on one side of said bed, at least one gap defined adjacent said guard rail, the improvement comprising:

a telescoping extender on said guard rail, moveable between the two positions, a first of said positions defining said gap and a second of said positions closing said gap;

said telescoping extender comprising a plurality of interlocking members which interlock so as to rotably communicate with one another;

said extender terminating in slidably locking members for mounting on one of said guard rails and for being slidably moveable on said guard rail between said first position and said second position.

* * * * *